US007771506B2

(12) United States Patent
Wada et al.

(10) Patent No.: US 7,771,506 B2
(45) Date of Patent: Aug. 10, 2010

(54) SPONGY SINTERED ARTICLE OF TITANIUM OR TITANIUM ALLOY EXHIBITING EXCELLENT COMPRESSION STRENGTH

(75) Inventors: Masahiro Wada, Ageo (JP); Takumi Shibuya, Ageo (JP)

(73) Assignee: Mitsubishi Materials Corporation, Tokyo (JP)

( * ) Notice: Subject to any disclaimer, the term of this patent is extended or adjusted under 35 U.S.C. 154(b) by 543 days.

(21) Appl. No.: 11/718,351

(22) PCT Filed: Nov. 14, 2005

(86) PCT No.: PCT/JP2005/020801

§ 371 (c)(1),
(2), (4) Date: May 1, 2007

(87) PCT Pub. No.: WO2006/051939

PCT Pub. Date: May 18, 2006

(65) Prior Publication Data

US 2008/0090719 A1 Apr. 17, 2008

(30) Foreign Application Priority Data

Nov. 15, 2004 (JP) ..... 2004-330180

(51) Int. Cl.
*B22F 3/00* (2006.01)

(52) U.S. Cl. ..... 75/245

(58) Field of Classification Search ..... 75/236, 75/245

See application file for complete search history.

(56) References Cited

U.S. PATENT DOCUMENTS

| | | | | |
|---|---|---|---|---|
| 4,331,477 | A | 5/1982 | Kubo et al. | |
| 4,693,721 | A | 9/1987 | Ducheyne | |
| 4,731,115 | A | 3/1988 | Abkowitz et al. | |
| 5,758,253 | A | 5/1998 | Teoh et al. | |
| 5,773,099 | A * | 6/1998 | Tanaka et al. | 427/529 |
| 5,800,162 | A | 9/1998 | Shimodaira et al. | |
| 5,848,351 | A | 12/1998 | Hoshino et al. | |
| 6,066,176 | A | 5/2000 | Oshida | |
| 6,117,592 | A | 9/2000 | Hoshino et al. | |
| 6,306,196 | B1 | 10/2001 | Date et al. | |
| 6,423,422 | B2 | 7/2002 | Wada et al. | |
| 2004/0243241 | A1 * | 12/2004 | Istephanous et al. | 623/17.14 |
| 2006/0002810 | A1 * | 1/2006 | Grohowski, Jr. | 419/2 |

FOREIGN PATENT DOCUMENTS

| | | | |
|---|---|---|---|
| EP | 0764489 | | 3/1997 |
| EP | 0776638 | | 6/1997 |
| JP | 6-212324 | A | 8/1994 |
| JP | 8-60274 | A | 3/1996 |
| JP | 10015054 | | 1/1998 |
| JP | 11-341 | A | 1/1999 |
| JP | 2001-49304 | | 2/2001 |
| JP | 2004-43976 | | 2/2004 |
| WO | 03092933 | | 11/2003 |

OTHER PUBLICATIONS

International Search Report for PCT/JP2005/020801 mailed Dec. 20, 2005.

* cited by examiner

*Primary Examiner*—Roy King
*Assistant Examiner*—Ngoclan T Mai
(74) *Attorney, Agent, or Firm*—Leason Ellis LLP.

(57) ABSTRACT

A spongy sintered article of titanium or titanium alloy having a three-dimensional network structure in which continuous pores opening to a surface and continuing with internal pores are formed, and having a porosity of 50 to 98%, the spongy sintered article having a composition consisting of 0.1 to 0.6% by mass of carbon and a remainder containing titanium and inevitable impurities, the inevitable impurities having an oxygen content limited to not more than 0.6% by mass, and the spongy sintered article exhibiting an excellent compression strength.

2 Claims, No Drawings

SPONGY SINTERED ARTICLE OF TITANIUM OR TITANIUM ALLOY EXHIBITING EXCELLENT COMPRESSION STRENGTH

CROSS REFERENCE TO RELATED APPLICATIONS

This is a U.S. national phase application under 35 U.S.C. §371 of International Patent Application No. PCT/JP2005/020801 filed Nov. 14, 2005, and claims the benefit of Japanese Application No. 2004-330180 filed Nov. 15, 2004. The International Application was published in Japanese on May 18, 2006 as International Publication No. WO 2006/051939 under PCT Article 21(2) the content of both applications are incorporated herein in their entirety.

TECHNICAL FIELD

The present invention relates to a spongy sintered article of titanium or titanium alloy exhibiting excellent compression strength. The spongy sintered article of titanium or titanium alloy exhibiting excellent compression strength can be used as raw materials for various materials requiring corrosion resistance, such as filters, electrodes for water electrolysis, filters for air purifiers, electrodes for fuel cells, and biomaterials.

BACKGROUND ART

Conventionally, a method for producing a typical porous sintered article of titanium or titanium alloy is known which includes mixing a titanium or titanium alloy powder with an organic binder to obtain a mixture, molding the mixture to obtain a shaped article, heating the shaped article to remove the organic binder to obtain a degreased article (hereafter, this step in which the shaped article is heated to remove the organic binder to obtain a degreased body is referred to as the degreasing step), and further heating the degreased article obtained in the degreasing step at a high temperature, thereby obtaining a sintered article of titanium or titanium alloy.

Since it is impossible to perform a complete degreasing in the above-mentioned degreasing step, a very small amount of the organic binder remains in the degreased article which is obtained by degreasing the shaped article. It is known that, when this degreased article having a very small amount of the organic binder remaining is heated at a high temperature to obtain a sintered article of titanium or titanium alloy, some of the carbon atoms of the hydrocarbon react with titanium to form a carbide, and as a result, the obtained sintered article of titanium or titanium alloy has a structure in which titanium carbide compound having an average particle diameter of 1 μm or more is dispersed in the microstructure thereof, and the composition of the sintered article contains 0.2 to 1.0% by mass of carbon (see Japanese Unexamined Patent Application, First Publication No. 2001-49304). Although this sintered article of titanium or titanium alloy is generally porous, the porosity thereof is as small as 1% or less. Such a sintered article of titanium or titanium alloy having a small porosity can be used for various mechanical parts, but cannot be used as raw materials for various materials requiring high porosity, such as various filters, electrodes for fuel cells, and biomaterials.

In general, a raw material for various materials requiring high porosity, such as various filters, electrodes for fuel cells, and biomaterials needs to have a porosity of 50% or more. As an example of a method for producing a spongy sintered article having high porosity, the following method is known.

To a metal powder are added and mixed an organic binder, a foaming agent and optionally a surfactant or the like to obtain a foaming slurry. Then, the obtained foaming slurry is molded into a shaped article, and the shaped article is dried by heating to foam the shaped article, thereby obtaining a green body having a porosity as high as 60% or more. Finally, the obtained green body having a high porosity is further heated at a high temperature to obtain a spongy sintered metal article having a high porosity. This spongy sintered metal article is known to have pores which open to the surface and continue with internal pores (hereafter, these pores are referred to as "continuous pores"), and a porosity of 50 to 98 volume % (see Japanese Unexamined Patent Application, First Publication No. 2004-43976 ("JP '976").

SUMMARY OF THE INVENTION

It is considered that a spongy sintered article of titanium or titanium alloy having a porosity of 50 to 98 volume % can be produced by the same method as that disclosed in JP '976, namely a method including: adding and mixing a commercially available titanium powder or titanium alloy powder with an organic binder, a foaming agent and the like to obtain a foaming slurry; molding the foaming slurry into a shaped article; drying the shaped article by heating to obtain a green body having a porosity as high as 60% or more; and further heating the green body having a high porosity at a high temperature, thereby producing a spongy sintered article of titanium or titanium alloy. However, such a spongy sintered article of titanium or titanium alloy having a porosity of 50 to 98 volume % produced by the above-mentioned conventional method has a disadvantageously low compression strength. Therefore, especially when the spongy sintered article of titanium or titanium alloy is used as electrodes for a fuel cell where it is required to stack the electrodes serially in a longitudinal direction, the electrodes cannot sustain the pressure, so that breakage of the electrodes occurs frequently.

In view of this situation, the present inventors have performed extensive and intensive studies with a view toward solving the above-mentioned problems. As a result, they found the following.

A hydrogenated titanium powder or a pure titanium powder obtained by dehydrogenating a hydrogenated titanium powder is prepared as a raw powder material, and is mixed with an aqueous resin binder, an organic solvent, a plasticizer, and optionally a surfactant, to obtain a slurry. The obtained slurry is molded into a shaped article, and the shaped article is dried by heating to obtain a spongy green body. Then, the spongy green body is placed on a zirconium oxide plate or an yttrium oxide plate and heated in a vacuum atmosphere to remove the organic binder to thereby obtain a degreased body having a porosity as high as 60% or more. The degreased body is further heated at a high temperature to effect sintering, thereby obtaining a sintered article of a titanium alloy. The present inventors have found that the thus obtained sintered article of a titanium alloy has a three-dimensional network structure in which continuous pores opening to a surface and continuing with internal pores are formed, and has a porosity of 50 to 98%; that this sintered article has a composition containing 0.1 to 0.6% by mass of carbon and a remainder containing titanium and inevitable impurities, the inevitable impurities having an oxygen content of not more than 0.6% by mass; and that this sintered article exhibits an extremely high compression strength.

The present invention has been completed based on these findings. Accordingly, the present invention provides:

(1) A spongy sintered article of titanium or titanium alloy having a three-dimensional network structure in which continuous pores opening to a surface and continuing with internal pores are formed, and having a porosity of 50 to 98%, the spongy sintered article having a composition containing 0.1 to 0.6% by mass of carbon and a remainder containing titanium and inevitable impurities, the inevitable impurities having an oxygen content limited to not more than 0.6% by mass, and the spongy sintered article exhibiting an excellent compression strength.

Further, when a microstructure of a skeleton part of the three-dimensional network structure has uniformly dispersed therein a titanium compound having an average particle diameter of 20 μm or less, the compression strength of the sintered article of titanium or titanium alloy is improved, and is consequently preferred. Accordingly, the present invention also provides:

(2) the spongy sintered article according to item (1) above, wherein a microstructure of a skeleton part of the three-dimensional network structure has uniformly dispersed therein a titanium carbide compound having an average particle diameter of 20 μm or less.

In the present invention, the reason for prescribing the composition of the spongy sintered article of titanium or titanium alloy exhibiting excellent compression strength as described above is as follows. When the amount of carbon is less than 0.1%, a satisfactory compression strength cannot be obtained. On the other hand, when the amount of carbon exceeds 0.6%, the amount of the titanium carbide compound having an average particle diameter of 20 μm or less which is uniformly dispersed in a microstructure of a skeleton part of the three-dimensional network structure becomes disadvantageously small, such that the spongy sintered article becomes too brittle for measuring the strength thereof.

In the spongy sintered article of titanium or titanium alloy exhibiting excellent compression strength according to the present invention, it is important to reduce the oxygen content. Oxygen has properties of inhibiting the sintering of the skeleton and lowering the sintered density of the skeleton part. Especially, a spongy sintered article is greatly influenced by oxygen due to the large surface area thereof. For this reason, it is preferable that the oxygen content be as small as possible. When the oxygen content exceeds 0.6%, disadvantages are caused in that the sintered density of the skeleton gets lowered and the compression strength becomes low. Therefore, in the present invention, the oxygen content of the spongy sintered article of titanium or titanium alloy exhibiting excellent compression strength according to the present invention is set to not more than 0.6%.

The method for producing the spongy sintered article of titanium or titanium alloy exhibiting excellent compression strength according to the present invention is as follows. Firstly, a hydrogenated titanium powder or a pure titanium powder obtained by dehydrogenating a hydrogenated titanium powder is prepared as a raw powder material. This raw powder material is mixed with an aqueous resin binder, an organic solvent, a plasticizer, water as a solvent, and optionally a surfactant, to obtain a metal powder slurry. The obtained metal powder slurry is molded into a sheet by a doctor blade method, and the sheet is foamed to obtain a spongy green body. Then, the spongy green body is placed on a zirconia plate and heated in a vacuum atmosphere to remove the organic binder to thereby obtain a degreased body. The degreased body is optionally cooled to 50° C. or lower in a vacuum atmosphere, followed by sintering in a vacuum atmosphere. Following the completion of sintering, argon gas is introduced into the furnace to cool the sintered article, thereby obtaining a spongy sintered article of titanium or titanium alloy exhibiting excellent compression strength according to the present invention.

The amount of carbon contained in the spongy sintered article of titanium or titanium alloy exhibiting excellent compression strength according to the present invention can be adjusted by changing the amount of the binder. Further, for suppressing the occurrence of oxidation to the utmost in the step of sintering the degreased body, it is necessary to place the degreased body in a titanium case or cover the degreased body with a titanium plate or a titanium foil during sintering.

As mentioned above, a hydrogenated titanium powder or a pure titanium powder may be used as a raw powder material. However, for producing the spongy sintered article of titanium or titanium alloy exhibiting excellent compression strength according to the present invention, it is easier to reduce the oxygen content by using a hydrogenated titanium powder as a raw powder material rather than a pure titanium powder.

The present invention can provide a spongy sintered article of titanium or titanium alloy exhibiting a high compression strength and having a high porosity. The spongy sintered article of titanium or titanium alloy exhibiting a high compression strength can be used as raw materials for various filters and electrodes for fuel cells. Therefore, the present invention greatly contributes to industrial development.

DETAILED DESCRIPTION OF THE INVENTION

As raw powder materials, a hydrogenated titanium powder having an average particle diameter of 15 μm and a pure titanium powder having an average particle diameter of 10 μm were prepared. Further, methylcellulose as an aqueous resin binder, neopentane, hexane and heptane as organic solvents, glycerin and ethylene glycol as plasticizers, water as a solvent, and an alkylbenzene sulfonate as a surfactant, were prepared.

The hydrogenated titanium powder, methylcellulose as an aqueous resin binder, neopentane, hexane and heptane as organic solvents, glycerin and ethylene glycol as plasticizers, and water as a solvent were formulated with the respective compositions as indicated in Table 1, and an alkylbenzene sulfonate as a surfactant was optionally added in an amount as indicated in Table 1. The resultants were individually kneaded for 15 minutes, thereby obtaining foaming slurries.

Subsequently, each of the foaming slurries was subjected to molding by a doctor blade method using a blade gap of 0.4 mm, to thereby form a slurry layer on a zirconia plate. Then, each of the zirconia plates having a slurry layer formed thereon was placed in a high temperature-high humidity vessel, followed by foaming at a temperature of 40° C. and a humidity of 90% for 20 minutes. The resultant was dried with warm air at a temperature of 80° C. for 15 minutes, thereby obtaining spongy green bodies.

Each of the obtained spongy green bodies as formed on the zirconia plate was passed through a degreasing apparatus to effect degreasing in air at a temperature of 550° C. and under a pressure of $5\times10^{-2}$ Pa for 5 hours, followed by cooling in a vacuum atmosphere to a temperature of 50° C. or lower to prevent oxidation, thereby obtaining degreased bodies.

Then, each of the obtained degreased bodies as formed on the zirconia plate was covered with a titanium plate or titanium foil for the purpose of oxygen gettering, and the resultant was passed through a sintering furnace to effect sintering at a temperature of 1,200° C. and under a pressure of $5\times10^{-3}$ Pa for 3 hours, thereby obtaining spongy sintered articles of titanium alloy 1 to 6 (hereafter, referred to as present sintered plates 1 to 6), comparative sintered articles of titanium alloy 1 to 3 (hereafter, referred to as comparative sintered plates 1 to 3) and conventional sintered article of titanium alloy 1 (hereafter, referred to as conventional sintered plate 1). Thereafter, an argon gas was introduced into the sintering furnace to effect cooling.

With respect to each of the present sintered plates 1 to 6, the comparative sintered plates 1 to 3 and the conventional sintered plate 1, the carbon concentration and the oxygen concentration were measured. The results are shown in Table 2. Further, each of the present sintered plates 1 to 6, the comparative sintered plates 1 to 3 and the conventional sintered plate 1 were cut to obtain samples. From the volume of the samples, the porosity was calculated by setting the true density as 4.5 g/cm$^3$. The results are shown in Table 2

Furthermore, a disc having a diameter of 20 mm as a test specimen was cut out from each of the present sintered plates 1 to 6, the comparative sintered plates 1 to 3 and the conventional sintered plate 1 by laser. Then, each of the test specimens was compressed to measure the rate-distortion curve. The compression strength was determined as the stress in the elastic boundary where the rate-distortion curve indicates a change from a line to a curve. The results are shown in Table 2.

TABLE 1

| | | Composition of slurry (% by mass) | | | | | | | | | |
|---|---|---|---|---|---|---|---|---|---|---|---|
| | | Raw powder material | | | | | | | | | |
| | | Pulverized, hydrogenated titanium | Pure titanium | Aqueous resin binder | Foaming agent | | | Plasticizer | | Surfactant | |
| Sintered plate | | powder | powder | Methylcellulose | Neopentane | Hexane | Heptane | Glycerin | Ethylene glycol | Alkylbenzene sulfonate | Solvent Water |
| Present | 1 | 60 | — | 3 | — | 2 | — | — | 2.5 | — | Remainder |
| Invention | 2 | 60 | — | 3 | — | — | 1.5 | — | 2.5 | 4 | Remainder |
| | 3 | 60 | — | 2.5 | 2 | — | — | — | 2.5 | 4 | Remainder |
| | 4 | — | 60 | 2 | 3 | — | — | 2.5 | — | 4 | Remainder |
| | 5 | — | 60 | 2.5 | 2 | — | — | 2.5 | — | 4 | Remainder |
| | 6 | — | 60 | 2.9 | 0.4 | — | — | 2.5 | — | 4 | Remainder |
| Comparative | 1 | — | 60 | 1 | 2 | — | — | 2.5 | — | — | Remainder |
| | 2 | — | 60 | 3.5 | 2 | — | — | 2.5 | — | 4 | Remainder |
| | 3 | — | 60 | 3 | 2 | — | — | — | 5 | 4 | Remainder |
| Conventional 1 | | — | 60 | 4 | 2 | — | — | — | 2.5 | 4 | Remainder |

TABLE 2

| | | Composition (% by mass) | | | Porosity | Compression |
|---|---|---|---|---|---|---|
| Sintered plate | | Carbon | Oxygen | Titanium | (%) | strength (MPa) |
| Present Invention | 1 | 0.3 | 0.28 | Remainder | 93 | 1.2 |
| | 2 | 0.4 | 0.27 | Remainder | 73 | 2.1 |
| | 3 | 0.2 | 0.25 | Remainder | 95 | 1.2 |
| | 4 | 0.12 | 0.43 | Remainder | 98 | 1.1 |
| | 5 | 0.4 | 0.48 | Remainder | 94 | 1.3 |
| | 6 | 0.57 | 0.5 | Remainder | 52 | 3.4 |
| Comparative | 1 | 0.05* | 0.38 | Remainder | 95 | 0.2 |
| | 2 | 0.8* | 0.67* | Remainder | 94 | Too brittle for measuring |
| | 3 | 0.3 | 0.73* | Remainder | 94 | Too brittle for measuring |
| Conventional 1 | | 1 | 1 | Remainder | 95 | Too brittle for measuring |

From the results shown in Table 2, it can be seen that the present sintered plates 1 to 6 in which the contents of carbon and oxygen have been adjusted exhibit a significantly improved compression strength as compared to comparative sintered plates 1 and 3 and conventional sintered plate 1.

The invention claimed is:

1. A spongy sintered article of titanium or titanium alloy having a three-dimensional network structure in which continuous pores opening to a surface and continuing with internal pores are formed, and having a porosity of 50 to 98%, said spongy sintered article having a composition containing 0.1 to 0.6% by mass of carbon and a remainder containing titanium and inevitable impurities, said inevitable impurities having an oxygen content limited to not more than 0.6% by mass, and said spongy sintered article exhibiting an excellent compression strength.

2. The spongy sintered article according to claim 1, wherein a microstructure of a skeleton part of said three-dimensional network structure has uniformly dispersed therein a titanium carbide compound having an average particle diameter of 20 μm or less.

* * * * *